US010527377B2

(12) United States Patent
Larish

(10) Patent No.: US 10,527,377 B2
(45) Date of Patent: Jan. 7, 2020

(54) UNIVERSAL AMBIDEXTROUS SPENT AMMUNITION CARTRIDGE CASE DEFLECTOR

(71) Applicant: Jack Ryan Larish, Lakeville, MN (US)

(72) Inventor: Jack Ryan Larish, Lakeville, MN (US)

(73) Assignee: Jack R. Larish, Lakeville, MN (US)

( * ) Notice: Subject to any disclaimer, the term of this patent is extended or adjusted under 35 U.S.C. 154(b) by 11 days.

(21) Appl. No.: 15/954,475

(22) Filed: Apr. 16, 2018

(65) Prior Publication Data

US 2019/0113295 A1 Apr. 18, 2019

Related U.S. Application Data

(60) Provisional application No. 62/486,499, filed on Apr. 18, 2017.

(51) Int. Cl.
*F41A 15/12* (2006.01)
*F41A 35/06* (2006.01)

(52) U.S. Cl.
CPC ..... *F41A 15/12* (2013.01); *F41A 35/06* (2013.01)

(58) Field of Classification Search
CPC ..... F41A 15/12; F41A 35/06
USPC ..... 42/90
See application file for complete search history.

(56) References Cited

U.S. PATENT DOCUMENTS

| | | | | |
|---|---|---|---|---|
| D270,078 | S * | 8/1983 | Buffum | 42/90 |
| 4,903,426 | A * | 2/1990 | Bammate | F41A 9/60 42/98 |
| 5,285,593 | A * | 2/1994 | Bammate | F41A 9/60 42/98 |
| 7,168,200 | B2 * | 1/2007 | Perez | F41A 9/60 42/98 |
| 7,493,720 | B1 * | 2/2009 | Householder | F41A 15/00 42/90 |
| 9,188,405 | B2 * | 11/2015 | Hawley | F41A 35/02 |

* cited by examiner

*Primary Examiner* — Samir Abdosh

(57) ABSTRACT

A safety device for redirecting spent ammunition cartridge cases away from a rifleman or bystander as they are ejected from the ejector port of a semiautomatic or automatic rifle. In a first embodiment, the center mounted embodiment is preferred. The presented device includes a mounting clamp assembly, mounting rod and pivoting deflector. The deflector can be pivoted to permit the ejection pattern desired by the rifleman. In a second embodiment, the side mounted assembly, the mounting clamp assembly is attached to the right hand side rail of the forearm and barrel assembly. In the third embodiment, rear mounted assembly, the clamp mounting assembly is installed at the rear of the upper receiver rail. In a fourth embodiment, forward mounted assembly, the mounting clamp assembly is mounted on the forearm upper accessory mounting rail. All embodiments described herein apply to a left-handed version of the rifle.

5 Claims, 26 Drawing Sheets

UNIVERSAL AMBIDEXTROUS SPENT AMMUNITION CARTRIDGE CASE DEFLECTOR

This application claims the priorities of U.S. Provisional Appl. 62/486,499 filed Apr. 18, 2017, the entire disclosures of which are incorporated herein by reference.

CROSS REFERENCE TO RELATED APPLICATIONS

None.

STATEMENT REGARDING FEDERALLY APPROVED RESEARCH OR DEVELOPMENT

None.

BACKGROUND OF THE INVENTION

1. Field of the Invention

This invention relates to the field of firearms, and in particular to devices that deflect spent ammunition cartridge cases away from a rifleman as they are ejected through the ejection port of an automatic or semiautomatic rifle while the rifle is being fired, such rifles including those of the U.S. Army's M4 series and the civilian AR-15 and AR-10 series. These designations refer to military style rifles often with collapsible butt stocks and shortened barrels. This invention relates further to such devices that, when mounted to a rifle, it does not prohibit or obstruct the attachment of an optical rifle telescope, carrying handle, holographic, red dot or other tactical sighting systems to the rifle.

2. Background Art

Semiautomatic and automatic rifles, including the M4, AR-15 and AR-10 series of rifles, are generally comprised of an upper receiver, a lower receiver that attaches to a lower portion of the upper receiver, a barrel assembly that attaches to a front portion of the upper receiver, and an ammunition magazine that inserts into a magazine well of the lower receiver. As the rifle is being fired, spent ammunition cartridge cases are ejected through an ejection port, which is usually located on the right side of the upper receiver, in which case the trajectory of the ejected cartridge cases is generally rightwards and rearwards with respect to the rifle and the rifleman who is firing the rifle. Models with the ejection port located on the left side of the upper receiver will send the ejected cartridges on a trajectory that is generally leftwards and rearwards with respect to the rifle and the rifleman who is firing the rifle. Consequently, the hot, spent cartridge cases will occasionally impact the head or shoulders of the rifleman, sometimes causing burns and other injuries. This is especially the case for a left-handed rifleman who, when firing the rifle with an ejection port on the right side of the upper, places the butt of the rifle against his left shoulder such that the right side of his face is positioned immediately to the rear of the ejection port. The rifleman is not the only individual impacted by the hot, spent cartridges. When these rifles are used at public or private gun ranges, other shooters or bystanders on the side that the ejection port is located are often struck by hot, spent cartridges.

U.S. Pat. No. 6,487,808 to Carey disclosed a combination spent cartridge case deflector and catcher, and breech block actuator for an automatic shotgun. The combination was comprised of a generally planar frame for attachment in vertical orientation to the side of the gun's receiver, and generally parallel therewith, in the area of the ejector port. A lower section of the planar frame supported a removable connection for a spent cartridge case catcher. The spent cartridge case catcher was a generally planar tab with an upper portion that was a generally planar platform oriented substantially perpendicular to the lower portion of the catcher. When the upper portion of the cartridge case catcher was installed on a shotgun, it extended into the ejection port opening, and a resilient plug located on an upper section of the planar frame was disposed generally midway along the length of the ejection port to direct a spent cartridge case downward so that the cartridge case would not fly far away from the user of the gun.

U.S. Pat. No. 4,691,615 to Brunton disclosed a new rifle receiver body for an M-16 rifle that incorporated a deflector portion adapted to divert spent cartridge cases away from the person of the user. The deflector was a boss located at the rear of the ejection port that jutted out from the right side of the rifle body.

U.S. Pat. No. 7,493,720 to Householder disclosed a spent cartridge deflector that utilized two different mounting methods. The deflector was able to be mounted in two locations, one requiring a carrying handle to be in place. The Householder device is only capable of being installed on rifles with the ejection port on the right side of the upper.

The spent ammunition cartridge deflecting devices disclosed by Carey, Brunton and Householder lack the capabilities and features of the present invention, specifically: the ability to be mounted to a right handed or left handed semiautomatic or automatic rifle without prohibiting or obstructing attachment of a carrying handle, rifle telescope, holographic, red dot or tactical aiming device to the rifle utilizing a single mounting method.

SUMMARY OF THE INVENTION

According to the present invention, a universal ambidextrous spent ammunition cartridge case deflector is provided for use with a semiautomatic or automatic rifle to protect a rifleman or bystander from being burned or otherwise injured by spent cartridge cases exiting the rifle ejector port while the rifle is being fired.

In a first embodiment of the deflector, for use with a monocular rifle scope or other accessory mounted on the rifle's upper receiver rail leaving access to said upper receiver rail directly above or near the top of the ejection port, the deflector comprises a mounting clamp assembly means mounted on the upper receiver rail to attach the mounting rod; a mounting rod that affixed to the mounting clamp assembly extending towards the front of the rifle and towards the rear of the rifle positions the mounting rod parallel and above the ejection port; a deflector plate attached to the mounting rod for deflecting spent ammunition cartridge cases downward and away from the rifleman; pivot means integral to the deflector plate for pivoting the deflector plate to the optimal angle for deflection while at the same time reducing the possibility of a used cartridge jamming upon ejection.

In a second embodiment of the deflector, for use with a carrying handle or other accessory mounted on the rifle's upper receiver rail leaving no access to said upper receiver rail, this embodiment attaches to the right side accessory rail on the barrel and forearm assembly. The deflector comprises a mounting clamp assembly means mounted on the forearm right side accessory rail to attach the mounting rod; a mounting rod that affixed to the mounting clamp assembly and extending toward the rear of the rifle from the front of the rifle positions the mounting rod parallel and above the ejection port; a deflector plate for deflecting spent ammunition cartridge cases downward and away from the rifleman; pivot means integral to the deflector plate for pivoting the deflector plate to the optimal angle for deflection while at the same time reducing the possibility of a used cartridge jamming upon ejection.

In a third embodiment of the deflector, for use with a red dot tactical sighting device or other accessory mounted on the rifle's upper receiver rail, this embodiment attaches forward of the sighting device or accessory to the upper accessory rail on the top of the barrel and forearm assembly. The deflector comprises a mounting clamp assembly means mounted on the forearm upper accessory rail to attach the mounting rod; a mounting rod that affixed to the mounting clamp assembly and extending toward the rear of the rifle from the front of the rifle positions the mounting rod parallel and above the ejection port; a deflector plate for deflecting spent ammunition cartridge cases downward and away from the rifleman; pivot means integral to the deflector plate for pivoting the deflector plate to the optimal angle for deflection while at the same time reducing the possibility of a used cartridge jamming upon ejection.

In a fourth embodiment of the deflector, for use with a red dot tactical sighting device or other accessory mounted on the rifle's upper receiver rail this embodiment attaches rearward of the sighting device or accessory to the upper receiver rail. The deflector comprises a mounting clamp assembly means mounted at the rear of the upper receiver rail to attach the mounting rod; a mounting rod that affixed to the mounting clamp assembly and extending from the rear of the rifle towards the front of the rifle positions the mounting rod parallel and above the ejection port; a deflector plate for deflecting spent ammunition cartridge cases downward and away from the rifleman; pivot means integral to the deflector plate for pivoting the deflector plate to the optimal angle for deflection while at the same time reducing the possibility of a used cartridge jamming upon ejection.

All four of the embodiments described above can also applied to models of these rifles with ejection port on the left hand side of the upper by reversing the mounting clamp assembly to project from the left side of the rifle.

The mounting clamp assembly means preferably includes a mounting clamp body having a transverse, threaded bore, a clamp lock having a transverse bore, and a clamp bolt inserted through the bore of the clamp lock. The clamp bolt has mating threads for insertion and threaded engagement within the transverse threaded bore of the mounting clamp body which draws the clamp lock tight securing the mounting assembly to the receiver or accessory rail. The mounting clamp body of the mounting clamp assembly includes a longitudinal aperture for insertion and retention of the mounting rod. The longitudinal aperture is intercepted by a transverse threaded bore which accepts a set screw that has mating threads and threaded engagement for retaining the mounting rod within the aperture. The mounting clamp block and the clamp lock have recesses designed to engage opposite sides of the upper receiver rail, and the upper, right and left side accessory rails on the barrel and forearm assembly.

The mounting rod is of a length capable of extending rearward or forward from the mounting clamp assembly to the deflector plate at its position above the ejection port.

The deflector plate having left and right side surfaces bounded by rear and front edges joined by top and bottom edges; mounting and pivot means integrated to top edge of the deflector plate, is positioned above the ejector port and is attached to the mounting rod.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

Figure 1:
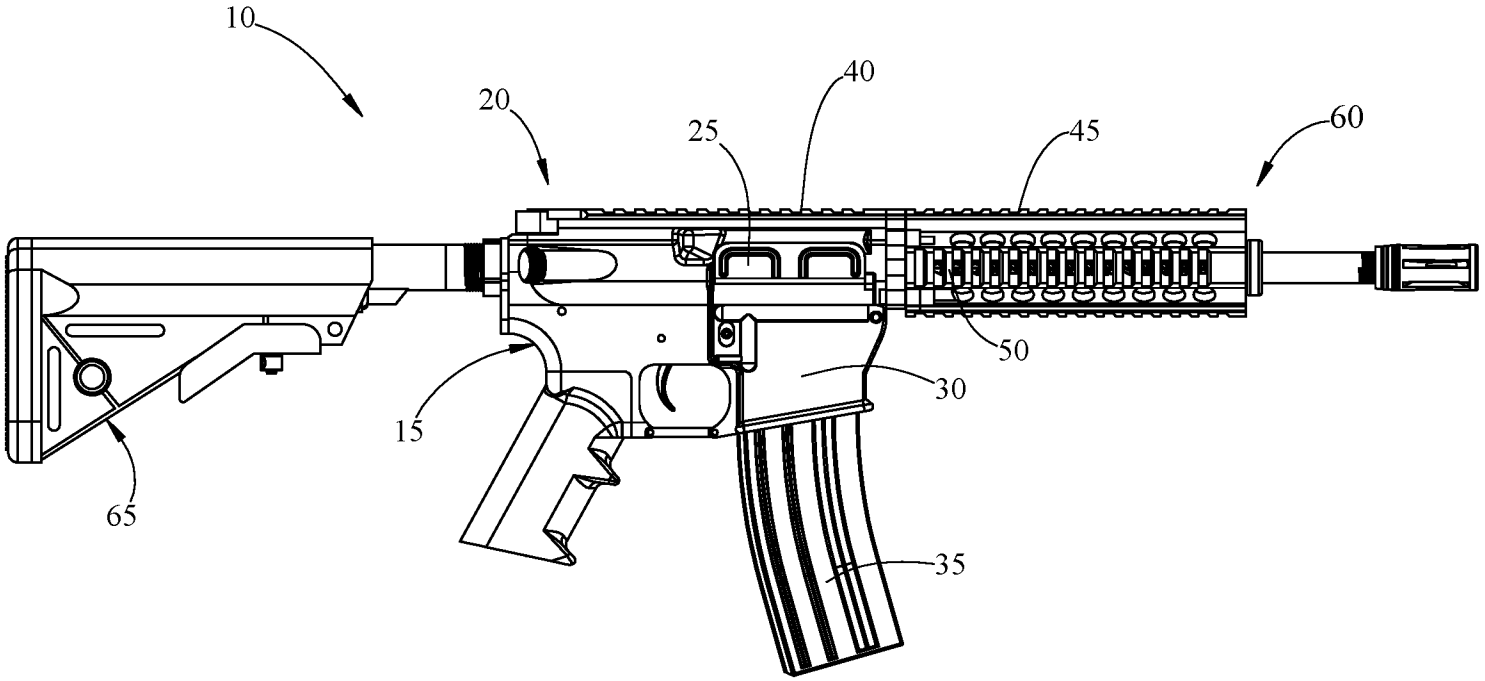
FIG. 1 is a right side, elevated view of a semiautomatic rifle of the M4, AR-15 and AR-10 design.
Figure 2:
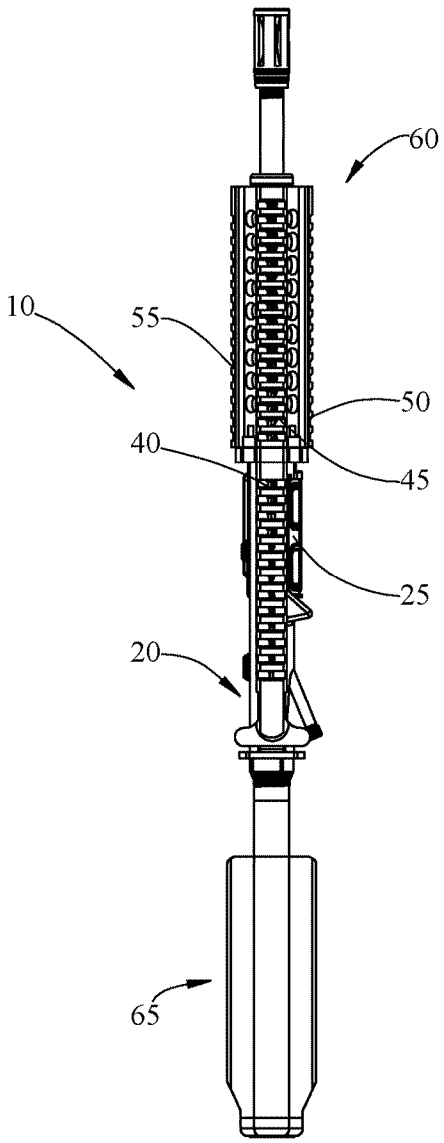
FIG. 2 is a top, plan view thereof.

In the figures, the terms "rear" and "front" refer to the left side and right sides of FIG. 1 and the right and left sides of FIG. 2, respectively.

DETAILED DESCRIPTION OF THE PREFERRED EMBODIMENTS

Figure 13:
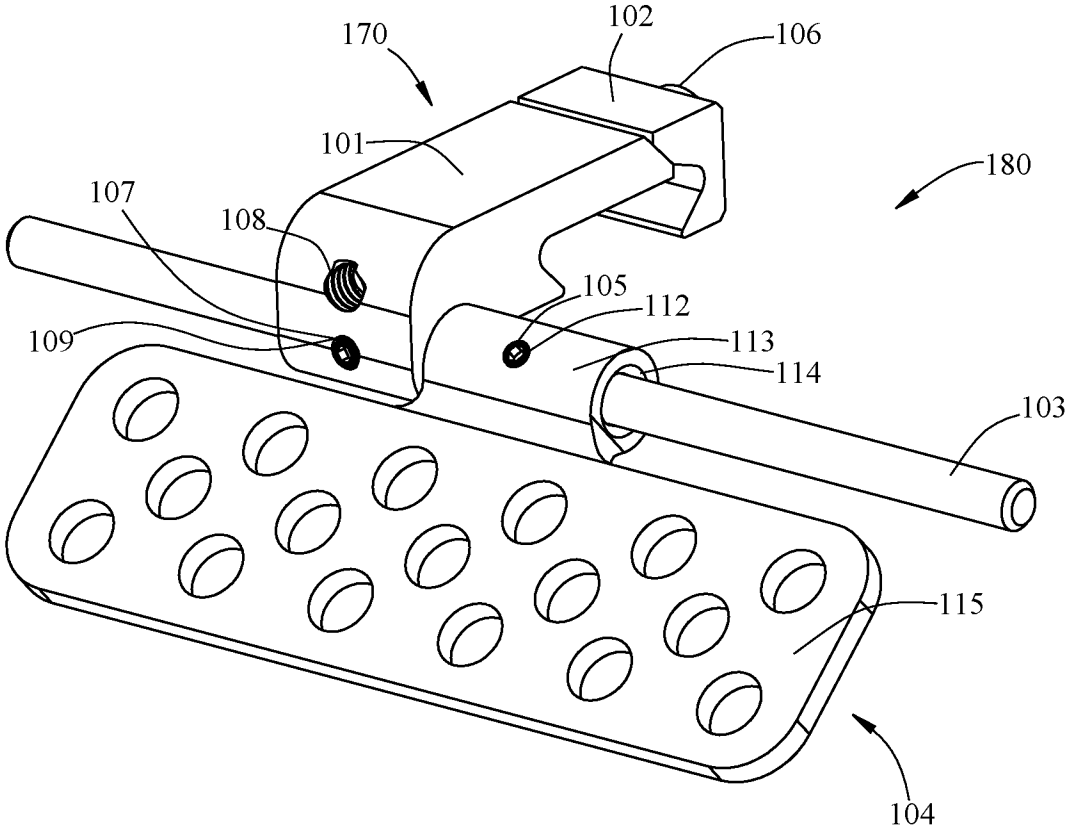
FIG. 13 is an assembly view of the first embodiment of the invention.
Figure 14:
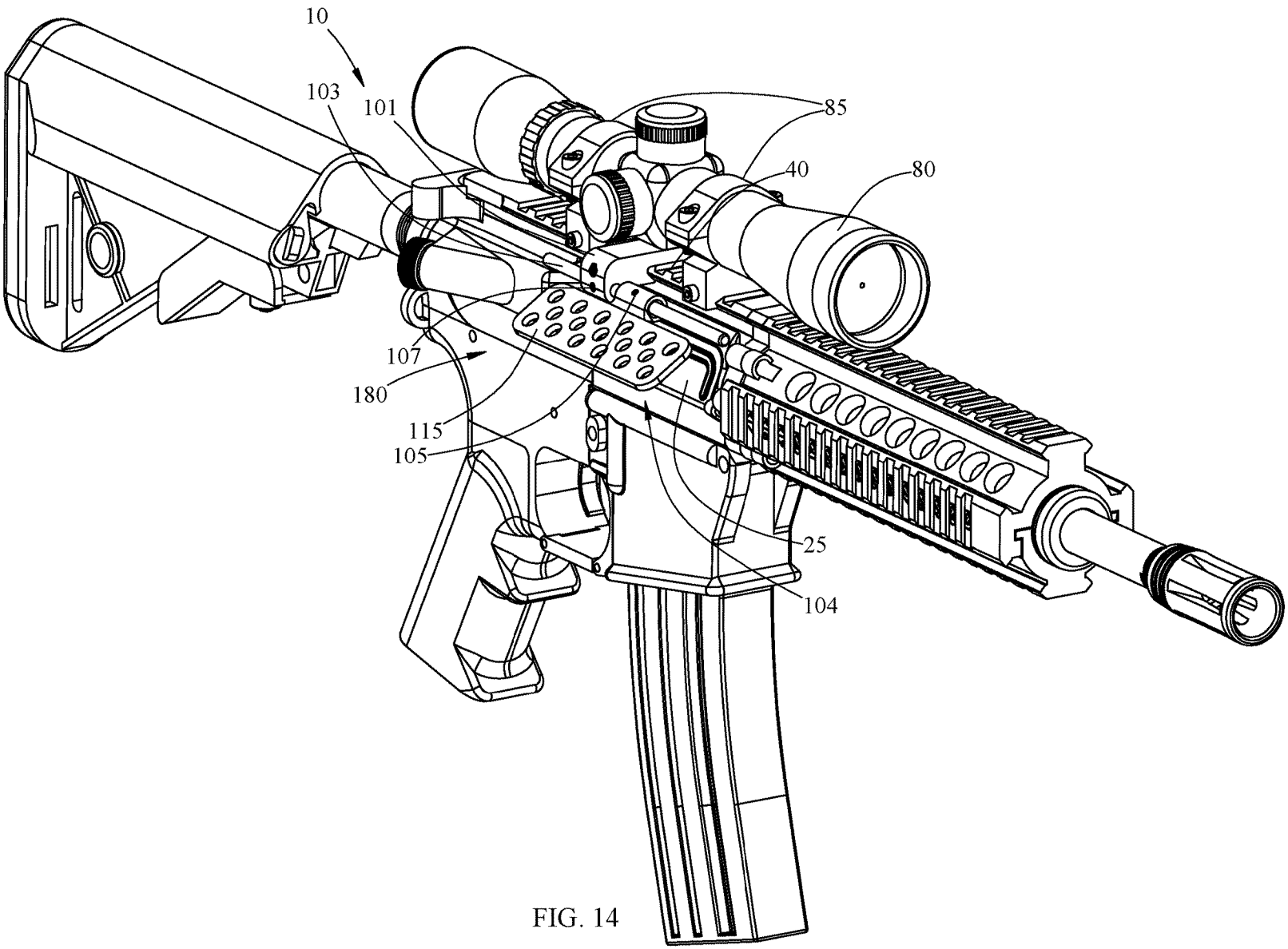
FIG. 14 is an elevated isometric view of the first embodiment mounted on a rifle.
Figure 15:
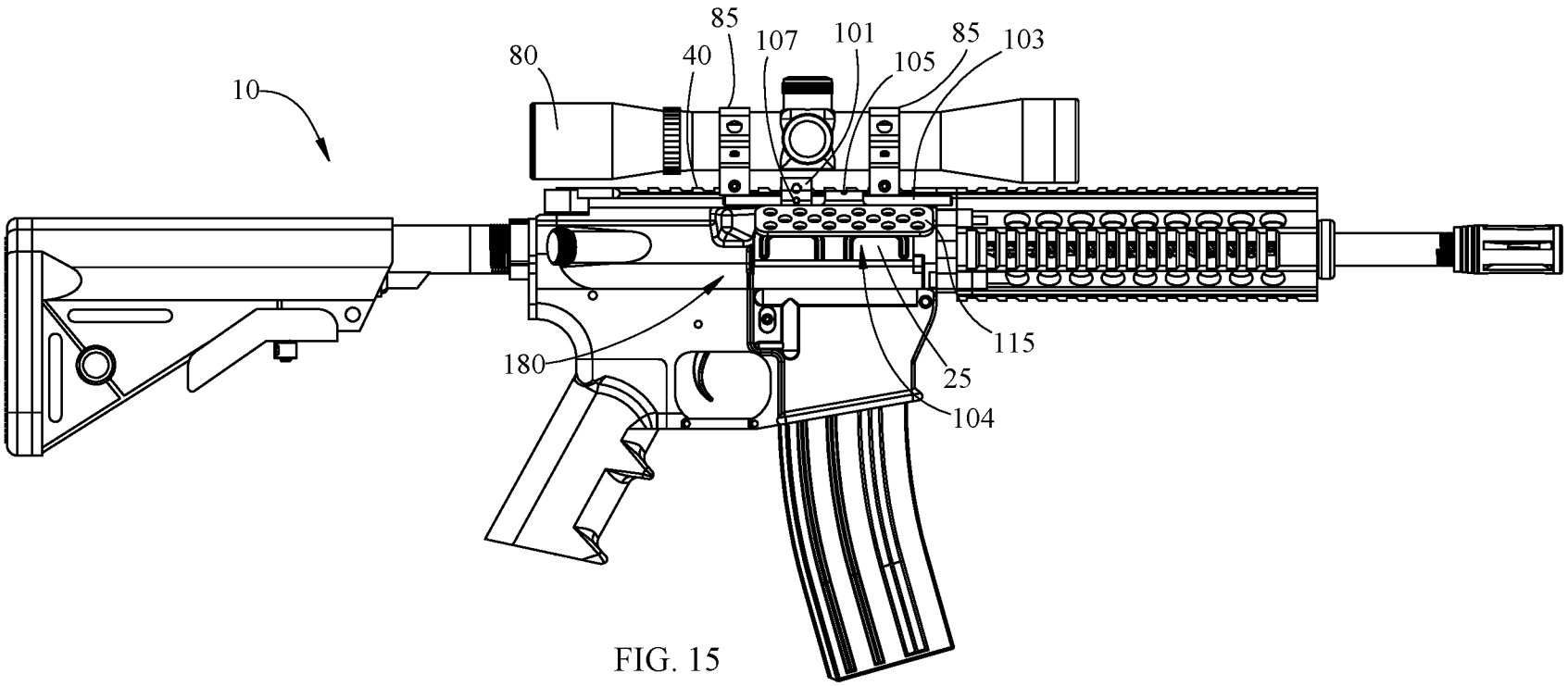
FIG. 15 is a side view of the first embodiment mounted on a rifle.
Figure 16:
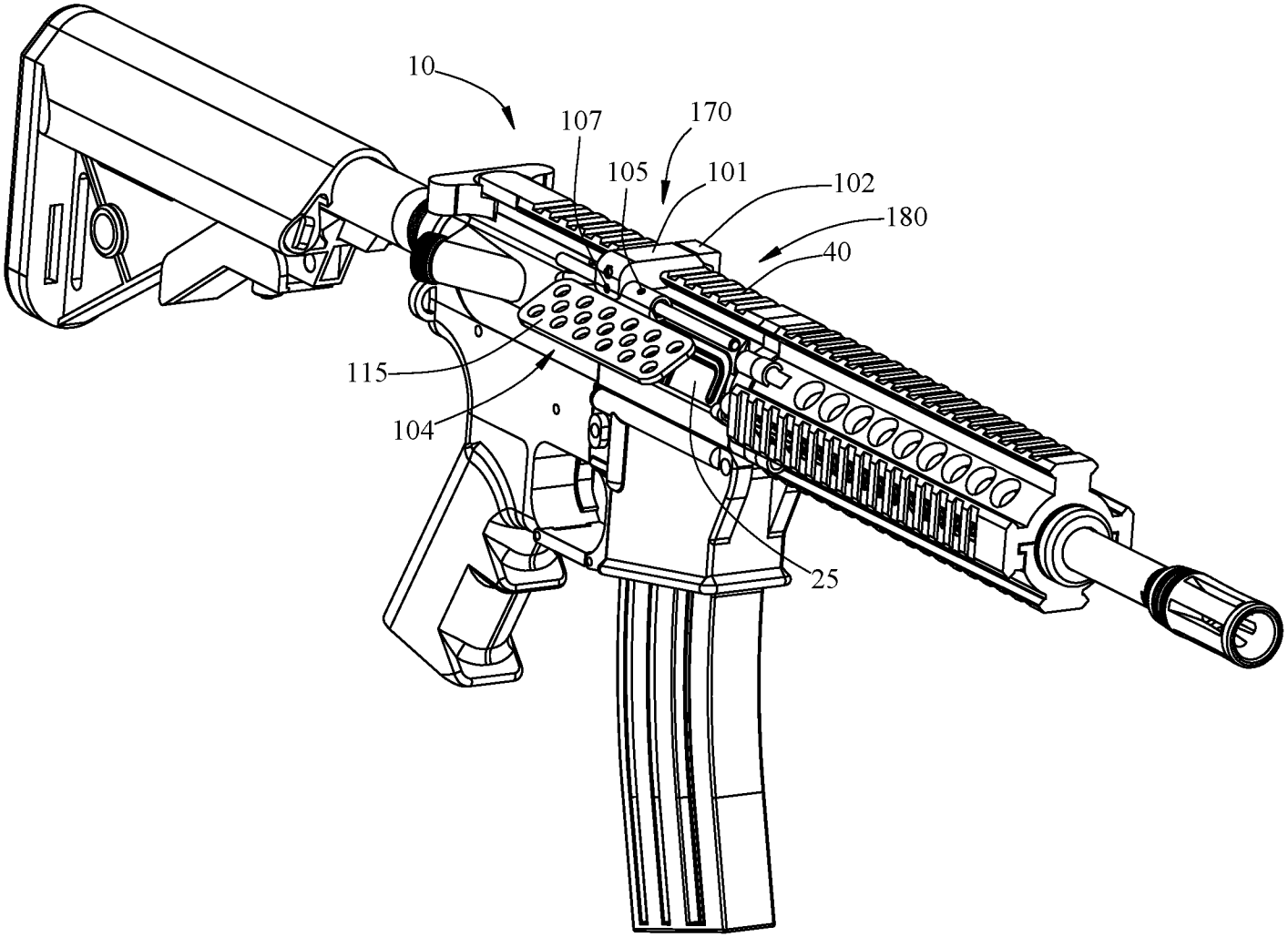
FIG. 16 is an elevated isometric view of the first embodiment mounted on a rifle with the scope removed for clarity thereof.

In a first embodiment FIG. 13, center mounted assembly 180, the universal ambidextrous spent ammunition cartridge case deflector of the present invention can be adapted for use with a semiautomatic or automatic rifle 10, such as the AR-15 rifle depicted in FIGS. 1 and 2. Referring to FIGS. 1 and 2, the rifle 10 is comprised of an upper receiver 20 that attaches to a lower receiver 15, a barrel and forearm assembly 60 that attaches to a front portion of the upper receiver, a butt stock 65 that attaches to the rear portion of the lower receiver 15, and an ammunition magazine 35 that inserts into a magazine well 30 of the lower receiver. The depicted rifles 10 have an upper receiver rail 40 to which a carrying handle, monocular rifle scope or other tactical sighting device can be alternately attached and detached from the rail; the barrel and forearm assembly 60 also contains mounting rails on top 45, the right hand side 50 and left side 55 as mounting points for additional accessories to the rifle. The ejection port 25 is the location from which expended ammunition cartridge cases are ejected from the rifle. As shown in FIGS. 14 and 15, a rifle 10 is depicted with a monocular rifle scope 80 mounted to the upper receiver rail 40 via two scope rings 85. FIG. 16 shows the first embodiment with the monocular rifle scope 80 and scope rings 85 removed to provide a more detailed view of the mounting clamp assembly 170 attached to the upper receiver rail 40. The clamp lock 102 is clearly visible in this view. FIG. 13 depicts the first embodiment, the center mounted assembly 180. The mounting clamp assembly 170, comprised of the clamp lock 102, mounting clamp body 101, clamp lock threaded fastener 106 and the clamp body set screw 107, accepts the mounting rod 103. The mounting rod 103 is retained in the clamp body by the clamp body set screw 107 threaded into the threaded bore 109. The clamp lock threaded fastener 106 is inserted through the clamp lock 102 and is threaded into the transverse threaded bore 108. The deflector 104, is attached to the mounting rod 103 by insertion into the deflector mounting rod aperture 114 located in the deflector pivot means 113. The mounting rod is retained by set screw 105 threaded into the deflector threaded bore 112. The deflector top 115 faces upward. Depending on the mounting location of the mounting clamp assembly 170 on the upper receiver rail, the deflector 104 can be mounted adjacent to either side of the mounting clamp assembly 170.

Referring to FIGS. 14, 15 and 16, in this first embodiment 180 the deflector 104 is positioned directly above the ejection port 25 with the deflector top 115 facing upwards. It is attached to the rifle 10 via the mounting rod 103 that is inserted into the deflector 104 and the clamp body 101 of the mounting clamp assembly 170. The mounting rod 103 is retained in the clamp body 101 via a set screw 107. The deflector 104 is retained on the mounting rod 103 via a set screw 105. The mounting rod 103 is inserted in the clamp body 101 with a length of the mounting rod 103 extending forward above and parallel to ejection port 25 of sufficient length to attach the deflector 104. The defector 104 will be fixed at a slightly downward slope as it extends out over the ejection port 25. The exact angle will vary as rifles 10 exhibit differences in ejection patterns due to manufacturing tolerances. The rifleman will need to adjust the downward sloping angle of the deflector 104 to match the ejection pattern of their rifle 10 and their preferred dispersion of deflection of expended ammunition cartridges. The first embodiment 180 of the deflector, therefore, is intended for use with a rifle 10 in conjunction with a monocular rifle scope 80, other sighting device or accessory attached to the upper receiver rail 40 with space available on the upper receiver rail 40 directly above or near the ejection port 25 to which the mounting clamp assembly 170 can be mounted.

Figure 3:
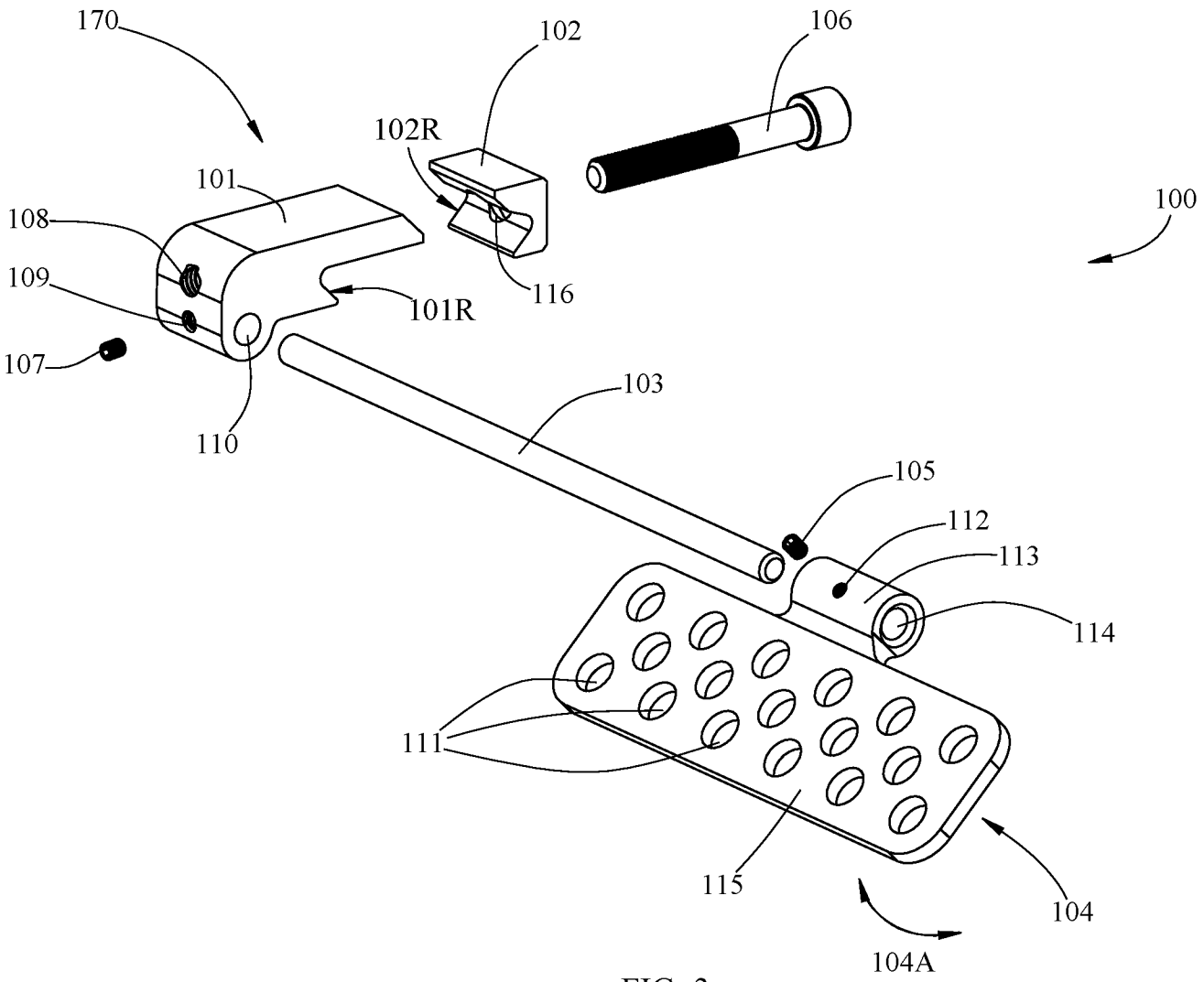
FIG. 3 is an exploded view of the embodiment components.

Referring to FIG. 3, all embodiments in the present invention utilize the same components. The clamp mount assembly 170 is comprised of the clamp body 101, clamp lock 102, clamp lock threaded fastener 106, and clamp body set screw 107. The clamp lock threaded fastener 106 is inserted through the clamp lock bore 116 and is threaded into the transverse threaded bore 108 in the mounting clamp body 101. The clamp body recess 101R; an opposing face of the clamp lock recess 102R are adapted to receive opposite side edges of any accessory rail. The other components are the mounting rod 103, deflector 104 and deflector set screw 105. One end of the mounting rod 103 is inserted into the deflector mounting rod aperture 114 located in the deflector pivot means 113 and the opposite end into the clamp body mounting rod aperture 110. In all embodiments of the presented invention the mounting rod is retained in the clamp body mounting rod aperture 110 by the clamp body set screw 107 threaded into the threaded bore 109 and it is retained in the deflector mounting rod aperture 114 by the deflector set screw 105 threaded into the threaded bore 112. The deflector rotates around the mounting rod 103 along the arc 104A. The exact position the deflector 104 is fixed along this arc is determined by the ejection pattern of the rifle and will vary based on manufacturing tolerances of said rifles. The deflector mounting rod aperture 114 and the clamp body mounting rod aperture 110 are mated closely to the diameter of the mounting rod 103. The deflector top 115 faces upward and the deflector gas vents 111 allow for dispersion of hot gases.

Figure 4:
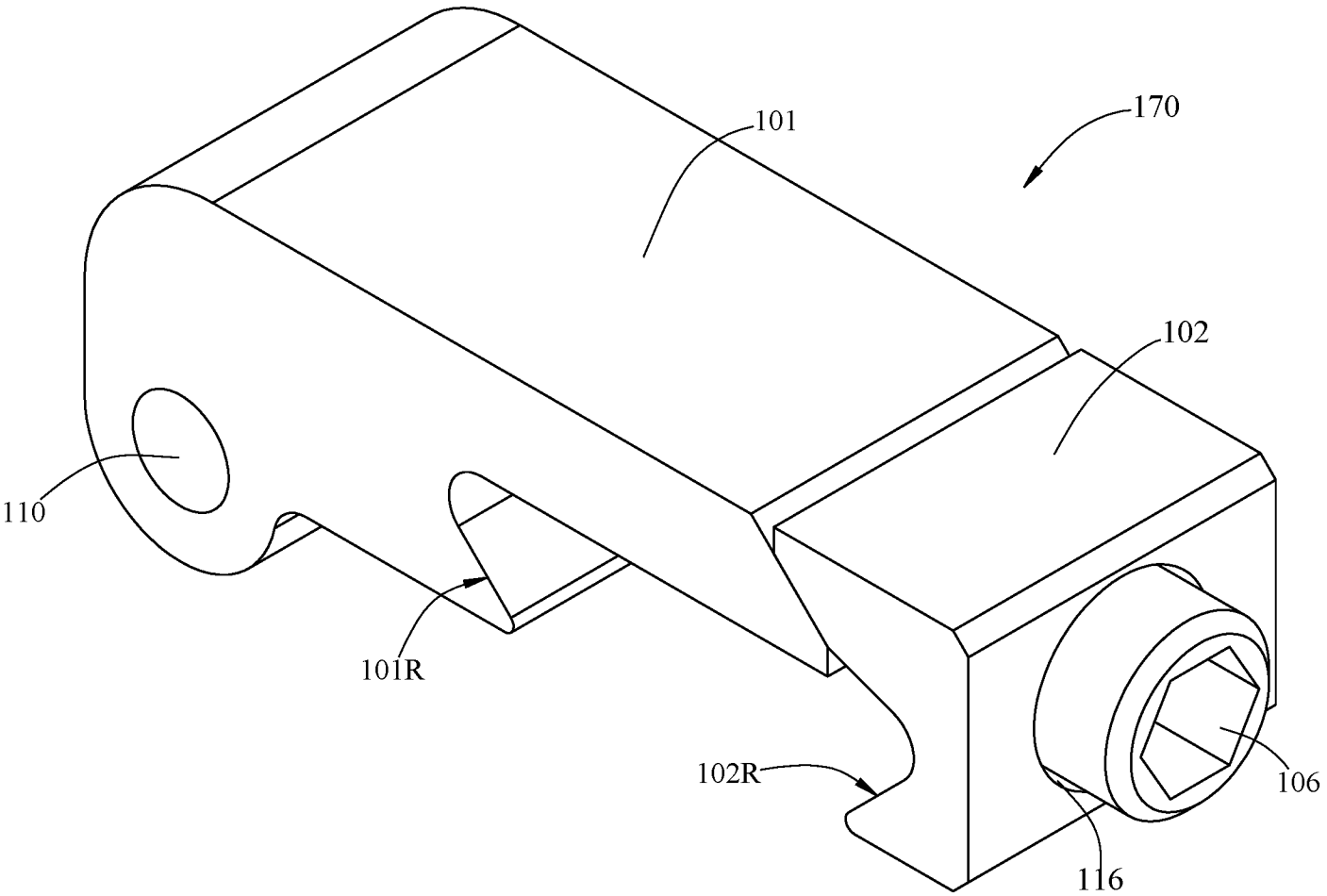
FIG. 4 is a elevated isometric view of the mounting clamp assembly, of the embodiment depicted in FIG. 3.
Figure 5:
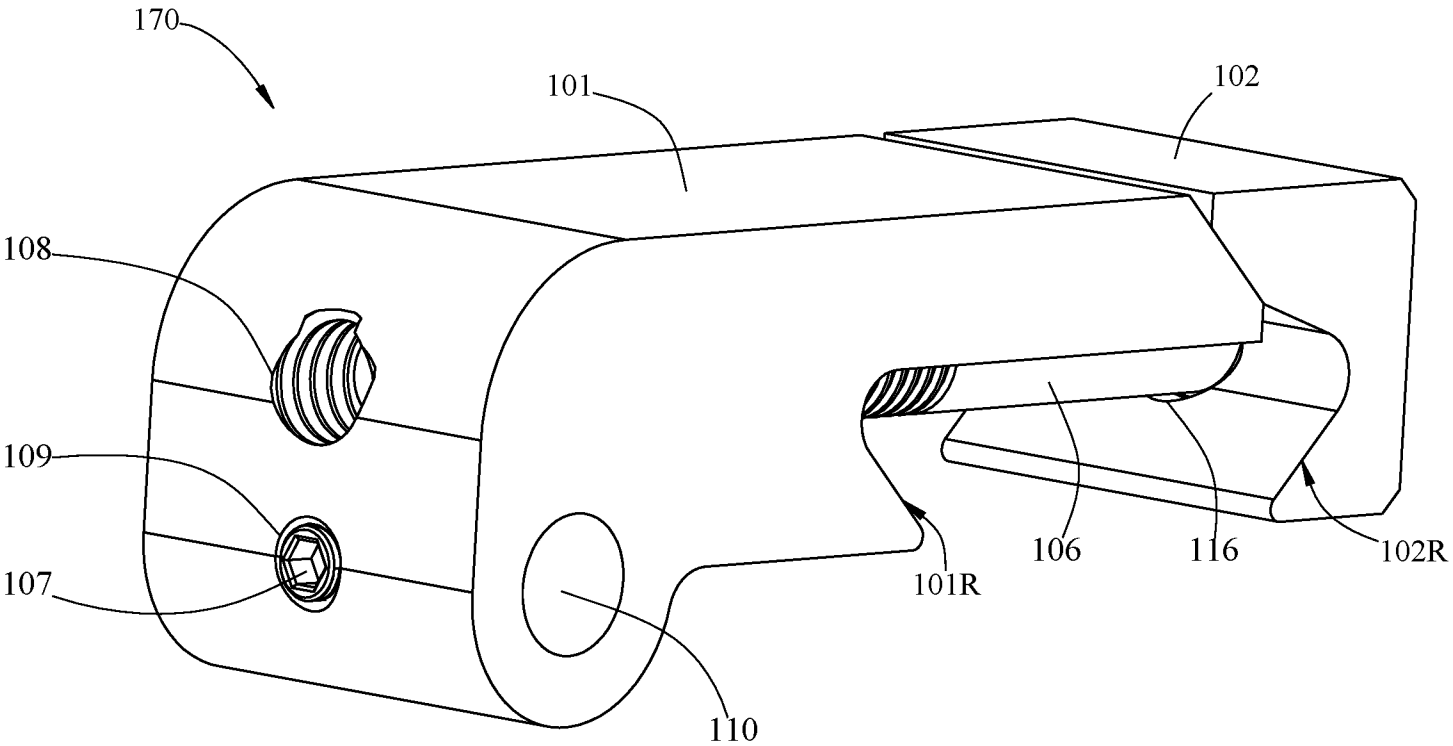
FIG. 5 is an isometric view of the mounting clamp assembly thereof.

Referring to FIGS. 4 and 5, presented are isometric views of the mounting clamp assembly 170. The mounting clamp assembly 170 includes the clamp body 101 having a transverse threaded bore 108, a clamp lock 102 having a transverse bore 116, and a clamp lock threaded fastener 106 inserted through the bore of the clamp lock 102 and having mating threads for insertion and threaded engagement within the threaded bore 108 of the clamp body 101. At the place of juncture of the clamp body 101 with the clamp lock 102 the clamp body has a recess 101R; an opposing face of the clamp lock has a recess 102R. The clamp body recess 101R and clamp lock recess 102R, are adapted to receive opposite side edges of the upper receiver rail 40 or forearm upper accessory rail 45 or forearm right side accessory rail 50 or forearm left side accessory rail 55. Rotation of the clamp lock threaded fastener 106 draws clamp body 101 and the clamp lock 102 together tightly, securing the mounting clamp assembly 170 to the upper receiver rail or forearm accessory rail available for each embodiment. The clamp body 101 also has a clamp body mounting rod aperture 110, intersected by a threaded bore 109 that set screw 107 having mated threads for insertion, is threaded into for retention of the mounting rod 103 after insertion. The mounting clamp assembly 170 aligns the mounting rod 103 parallel to and above the ejection port 25 in all embodiments. The mounting clamp assembly 170 attaches all embodiments of the presented invention to the rifle 10.

Figure 6:
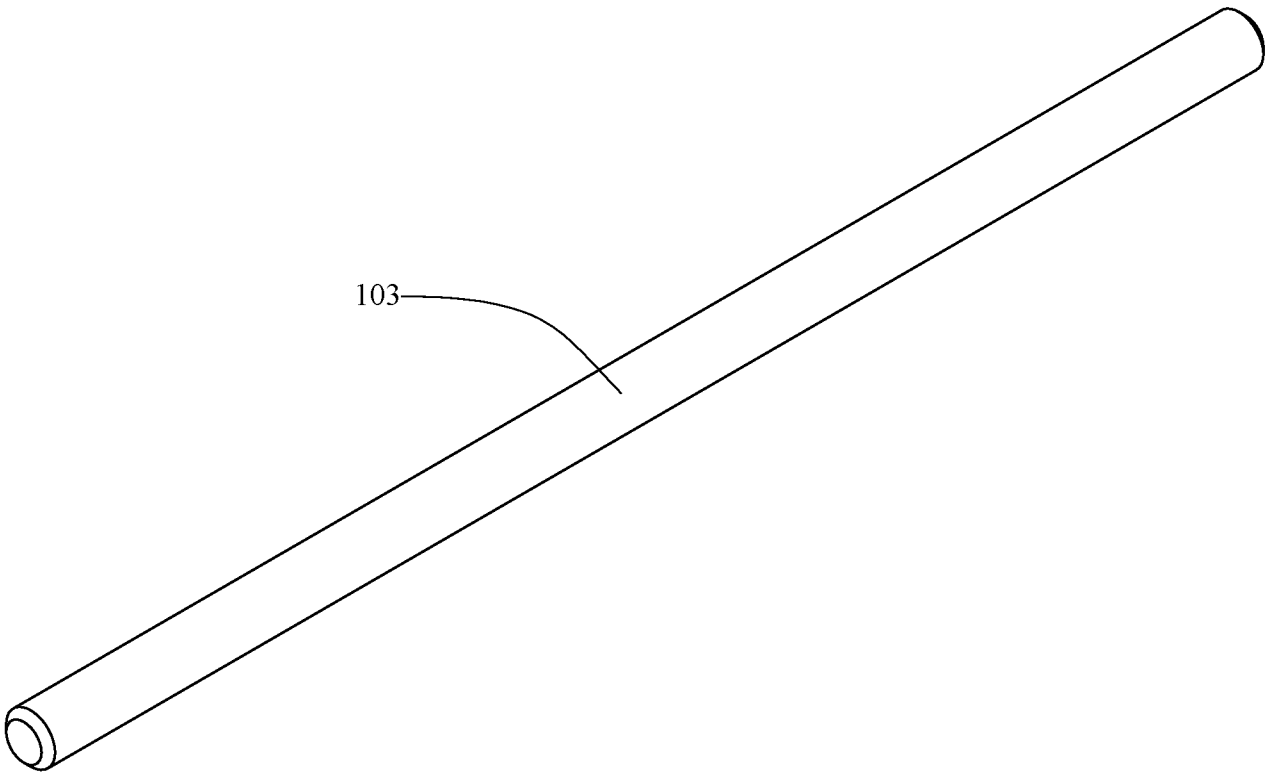
FIG. 6 is an isometric view of the mounting rod.
Figure 7:
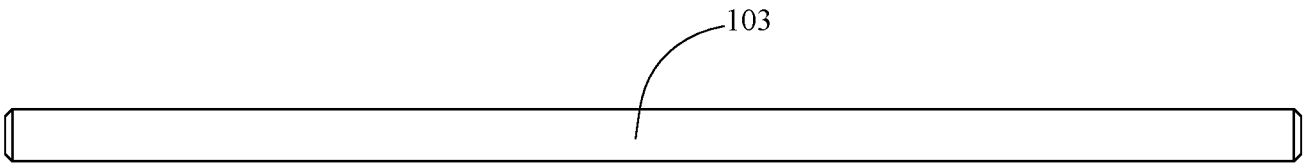
FIG. 7 is a side view.
Figure 8:
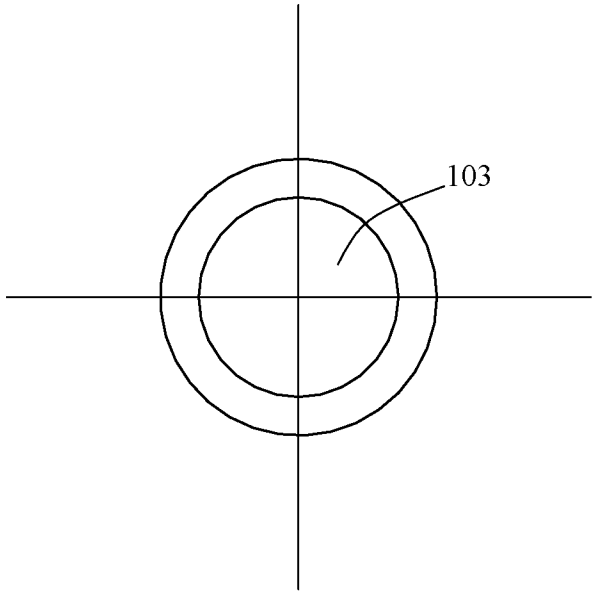
FIG. 8 is an end view thereof.
Figure 9:
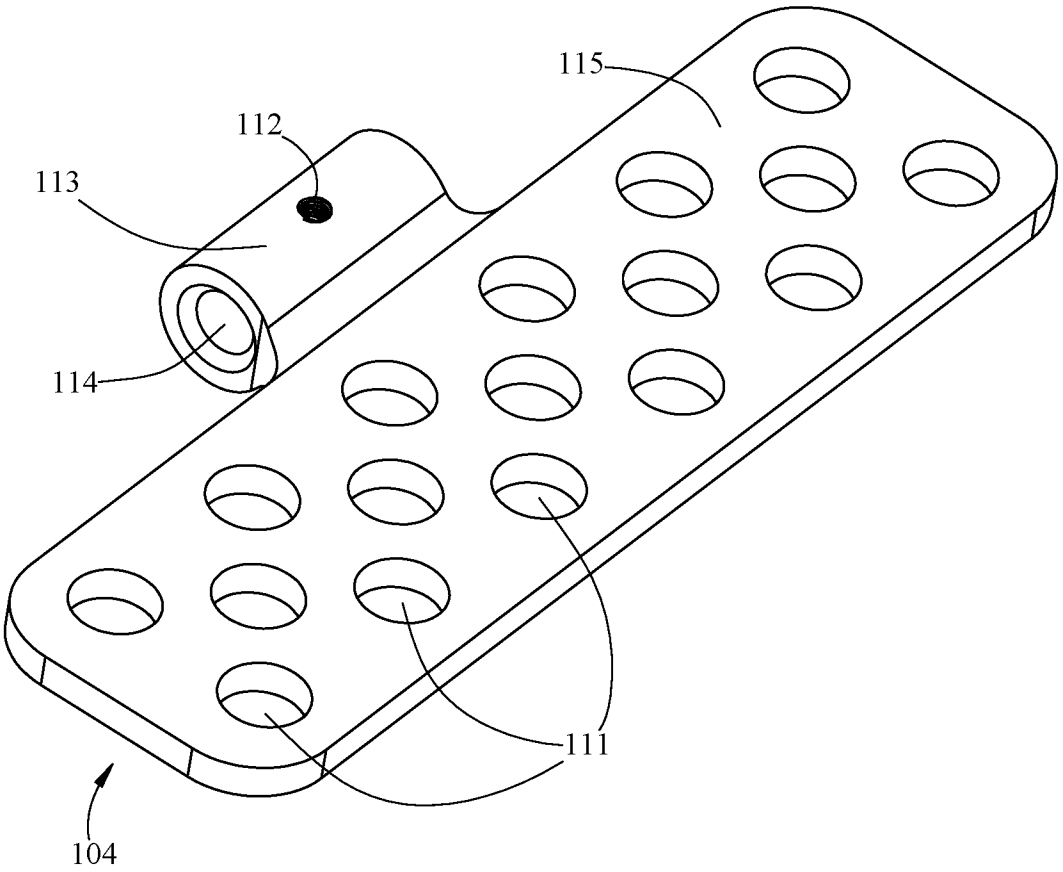
FIG. 9 is a elevated isometric view of the deflector.
Figure 10:
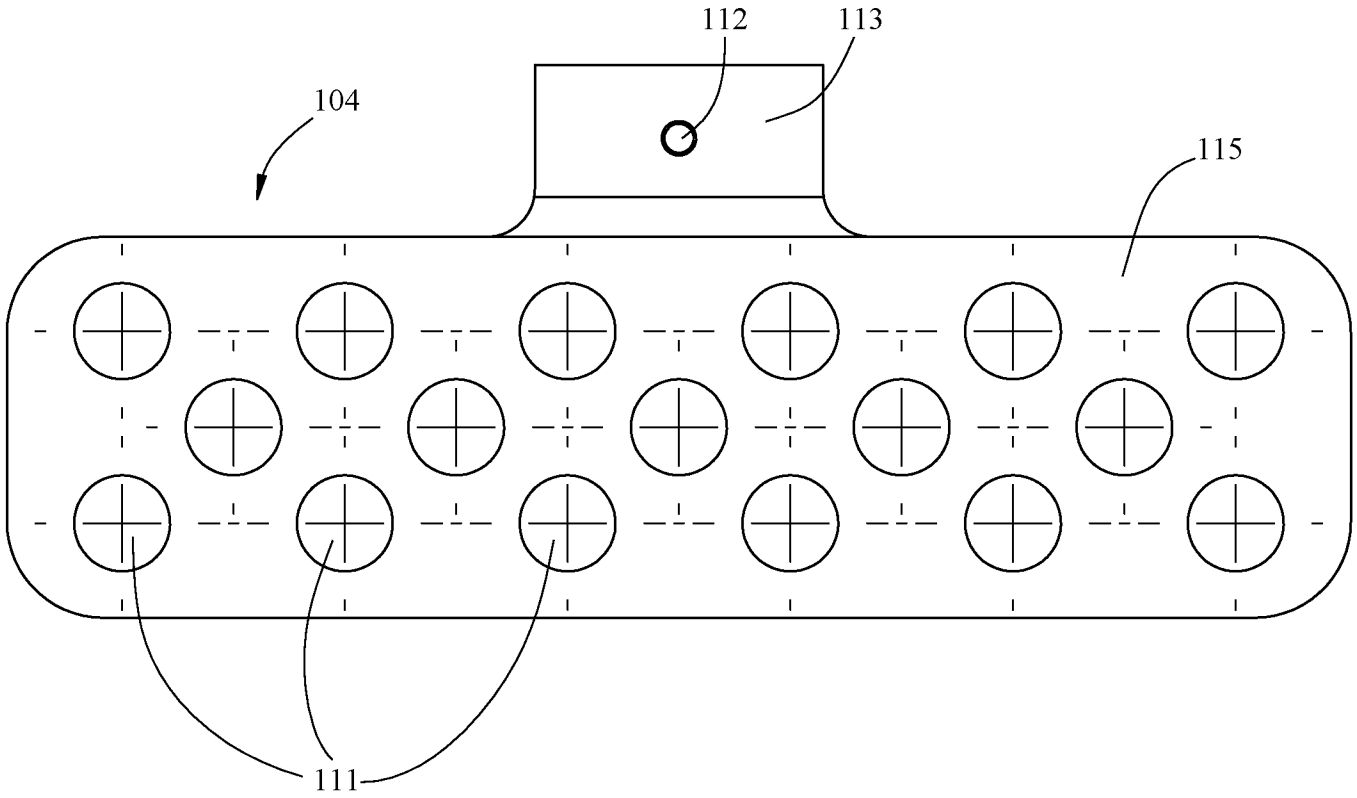
FIG. 10 is a top view.
Figure 11:
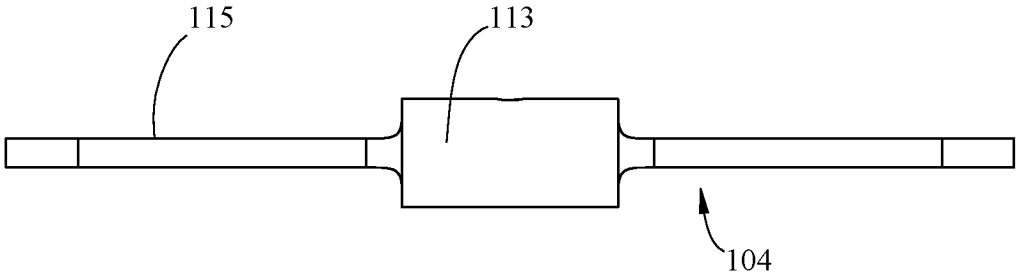
FIG. 11 is a side view.
Figure 12:
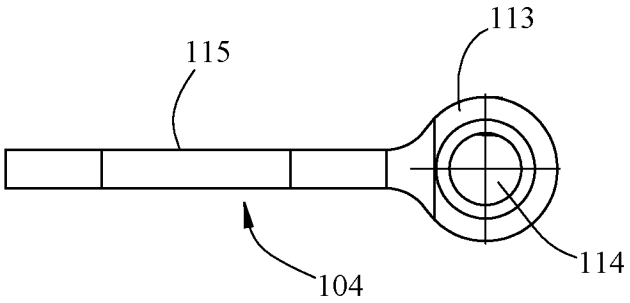
FIG. 12 is an end view thereof.

Referring to FIGS. 6, 7 and 8 the mounting rod 103 is cylindrical and of a length to position of the deflector 104 above and parallel to the ejection port 25 from the mounting clamp assembly 170 in all mounting embodiments.

Referring to FIGS. 9, 10, 11 and 12 the deflector 104 is perforated by deflector gas vents 111 to allow for hot gases from the ejection port 25 to escape without deflecting said hot gases onto the rifleman's hand while operating the rifle 10. The deflector top 115 is always installed facing up towards the top of the rifle 10 in all embodiments. This facilitates access to the deflector threaded bore 112 that accepts a set screw 105 having mating threads which retains the deflector 104. The deflector threaded bore 112 intercepts the deflector mounting rod aperture 114 in the deflector pivot means 113. After insertion of the mounting rod 103 it is tightened in place by rotation of the set screw 105 to retain the deflector 104 on the mounting rod 103 at the desired angle of deflection desired by the rifleman.

Figure 17:
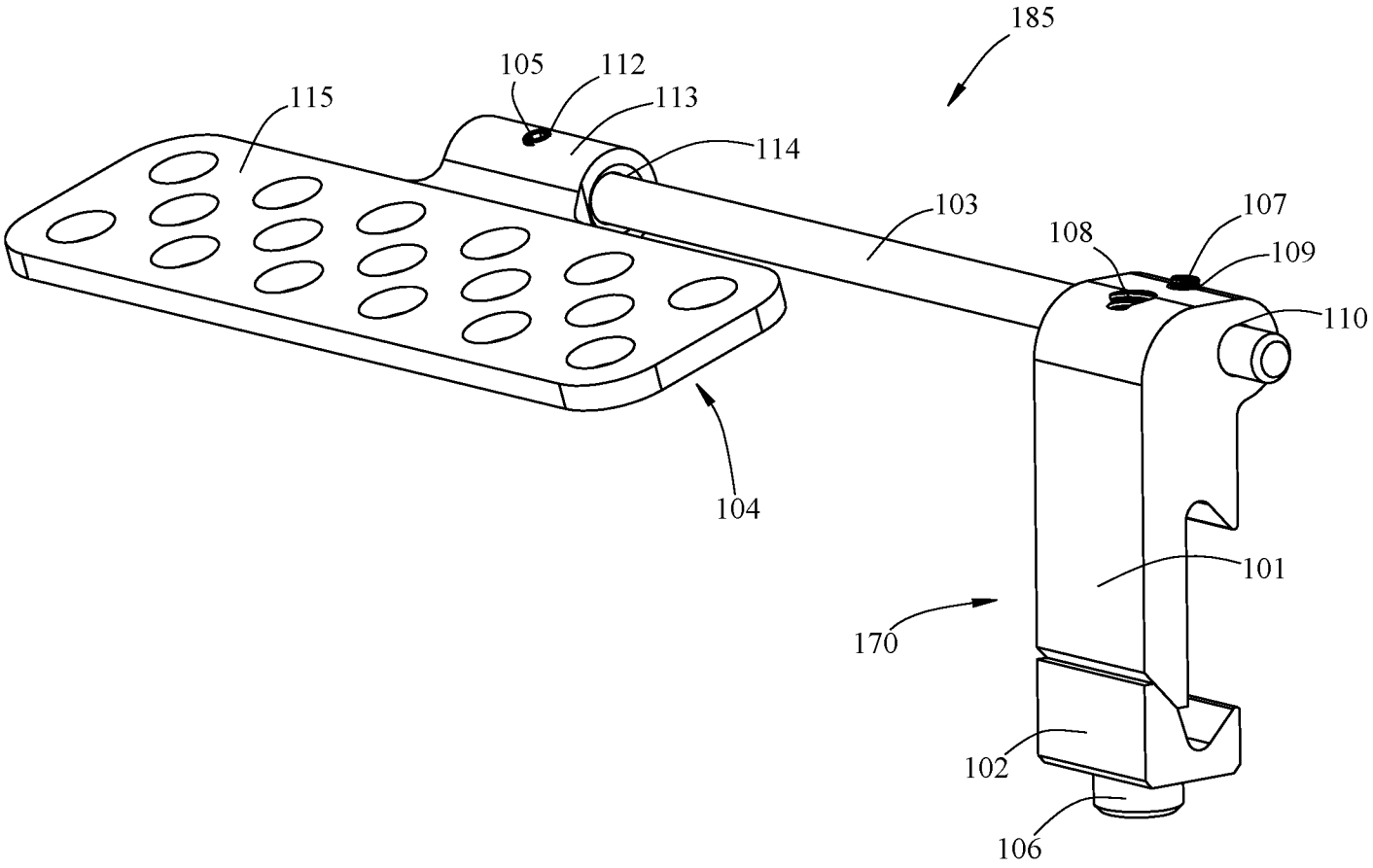
FIG. 17 is an assembly view of the second embodiment of the invention.
Figure 18:
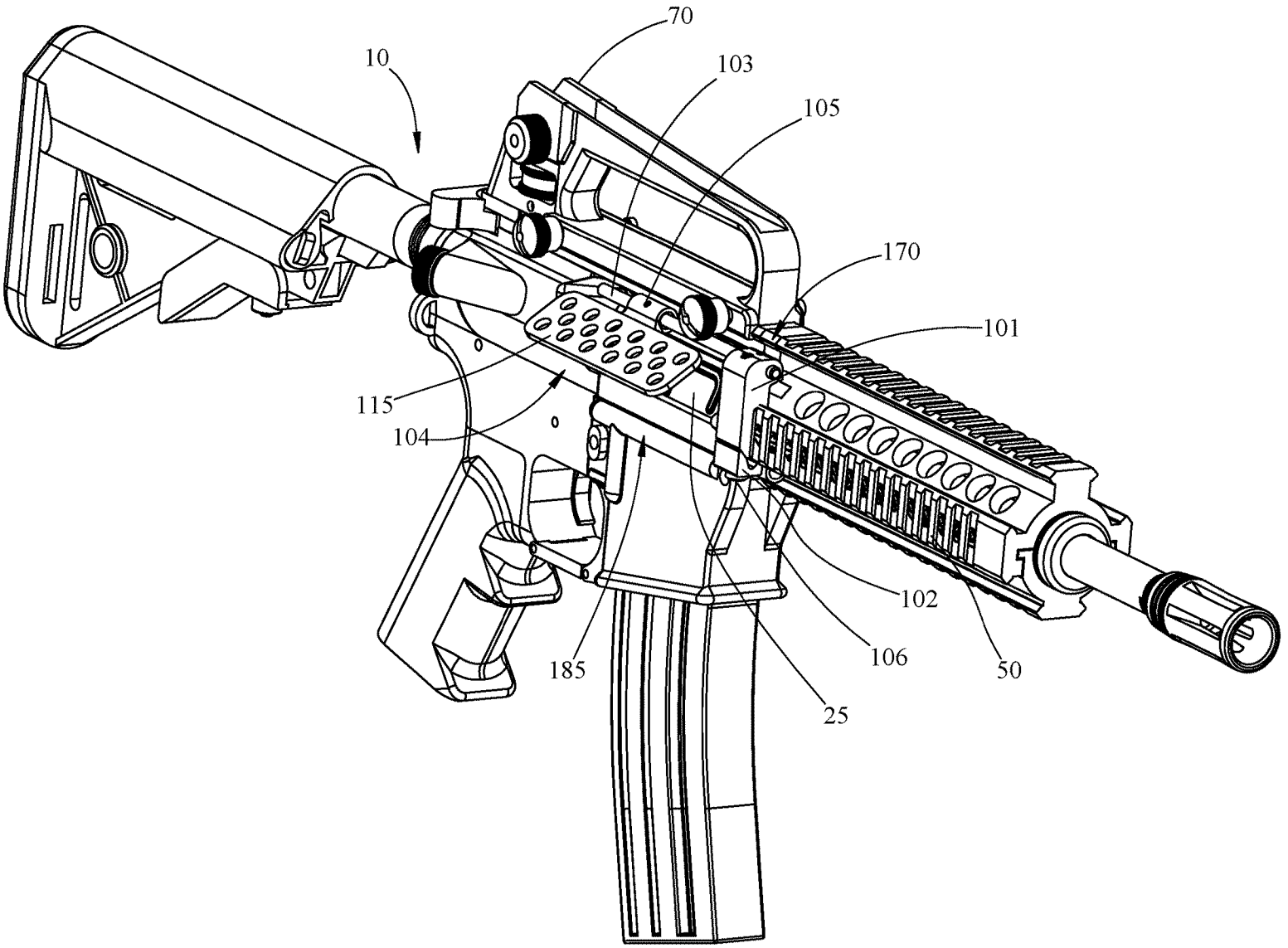
FIG. 18 is an elevated isometric view of the second embodiment mounted on a rifle.
Figure 19:
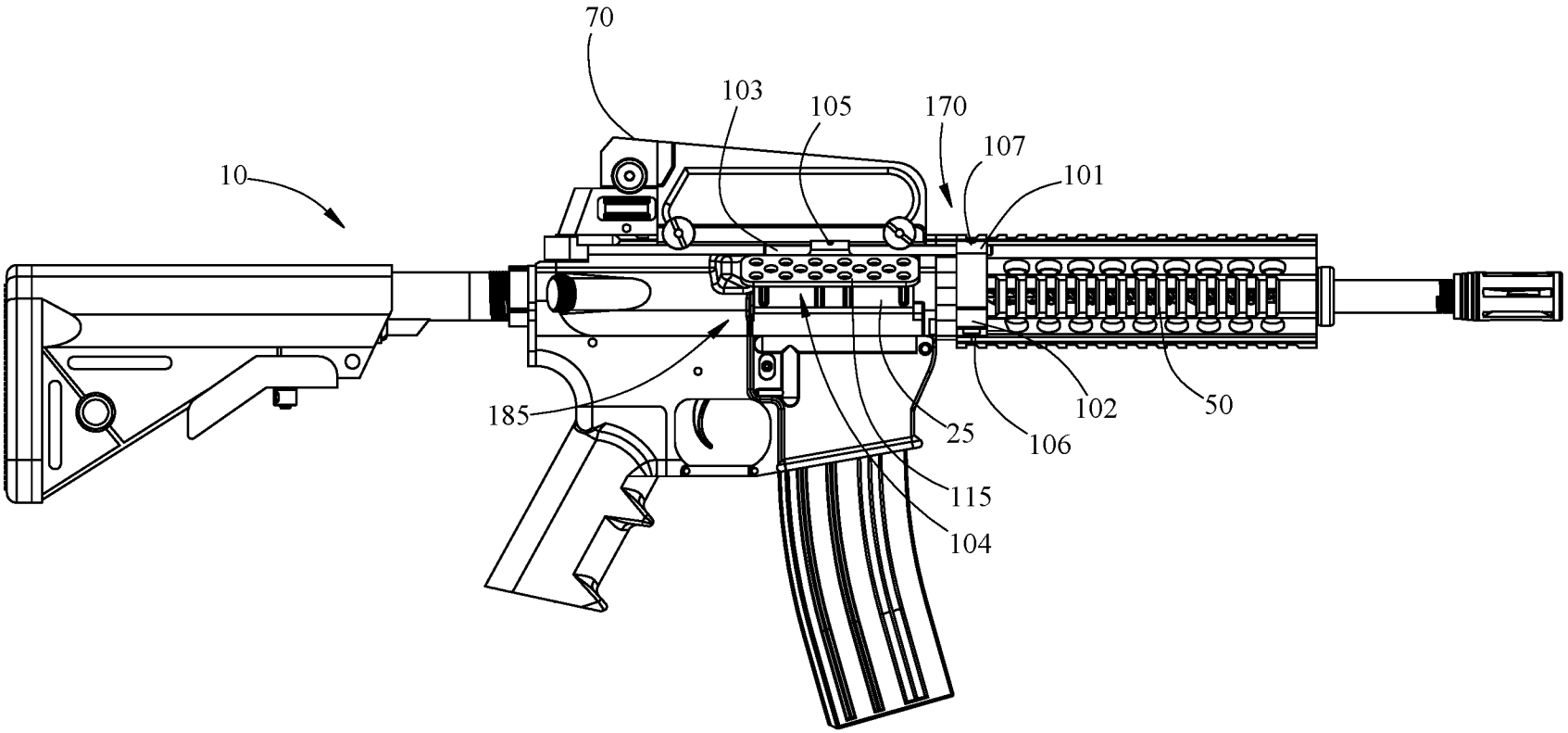
FIG. 19 is a side view of the second embodiment mounted on a rifle thereof.

In a second embodiment FIG. 17, side mounted assembly 185, the universal, ambidextrous spent ammunition cartridge case deflector of the present invention can be adapted for use with a semiautomatic or automatic rifle 10, such as the AR-15 rifle depicted in FIGS. 1 and 2. Referring to FIG. 17 the mounting clamp assembly 170 is located at one end of the mounting rod 103 and the deflector 104 is positioned at the opposite end. The mounting clamp assembly 170 is positioned in the second embodiment with clamp body 101 facing upwards towards the top of the rifle 10 and the clamp lock 102 and clamp lock threaded fastener 106 positioned downward. As shown in FIGS. 18 and 19, a carrying handle 70 has been mounted to the upper receiver rail 40. The clamp mounting assembly 170 is mounted to the forearm right side accessory mounting rail 50 with the mounting rod 103 extending rearward from the clamp mounting assembly 170. The clamp lock threaded fastener 106 inserted through the bore of the clamp lock 102 and having mating threads for insertion and threaded engagement within the threaded bore 108 of the clamp body 101. The clamp body 101 also has a clamp body mounting rod aperture 110, intersected by a threaded bore 109 that set screw 107 having mated threads for insertion, is threaded into for retention of the mounting rod 103 after insertion. Referring to FIGS. 17, 18 and 19 this second embodiment 185, the deflector 104 is positioned with the deflector top 115 facing upwards directly above the ejection port 25. It is attached to the rifle 10 via the mounting rod 103 that is inserted into the deflector pivot 113 in the deflector mounting rod aperture 114 and the clamp body 101 in the clamp body mounting rod aperture 110. The mounting rod 103 is retained in the clamp body mounting rod aperture 110 via a set screw 107. The mounting rod 103 is retained in the deflector mounting rod aperture 114 by the set screw 105. This second embodiment 185 of the deflector, therefore, is intended for use with a rifle 10 in conjunction with a carrying handle 70, other sighting device or accessory attached to the upper receiver rail 40 that leaves no space available on the upper receiver rail 40 directly above the ejection port 25 to mount the mounting clamp assembly 170.

Figure 20:
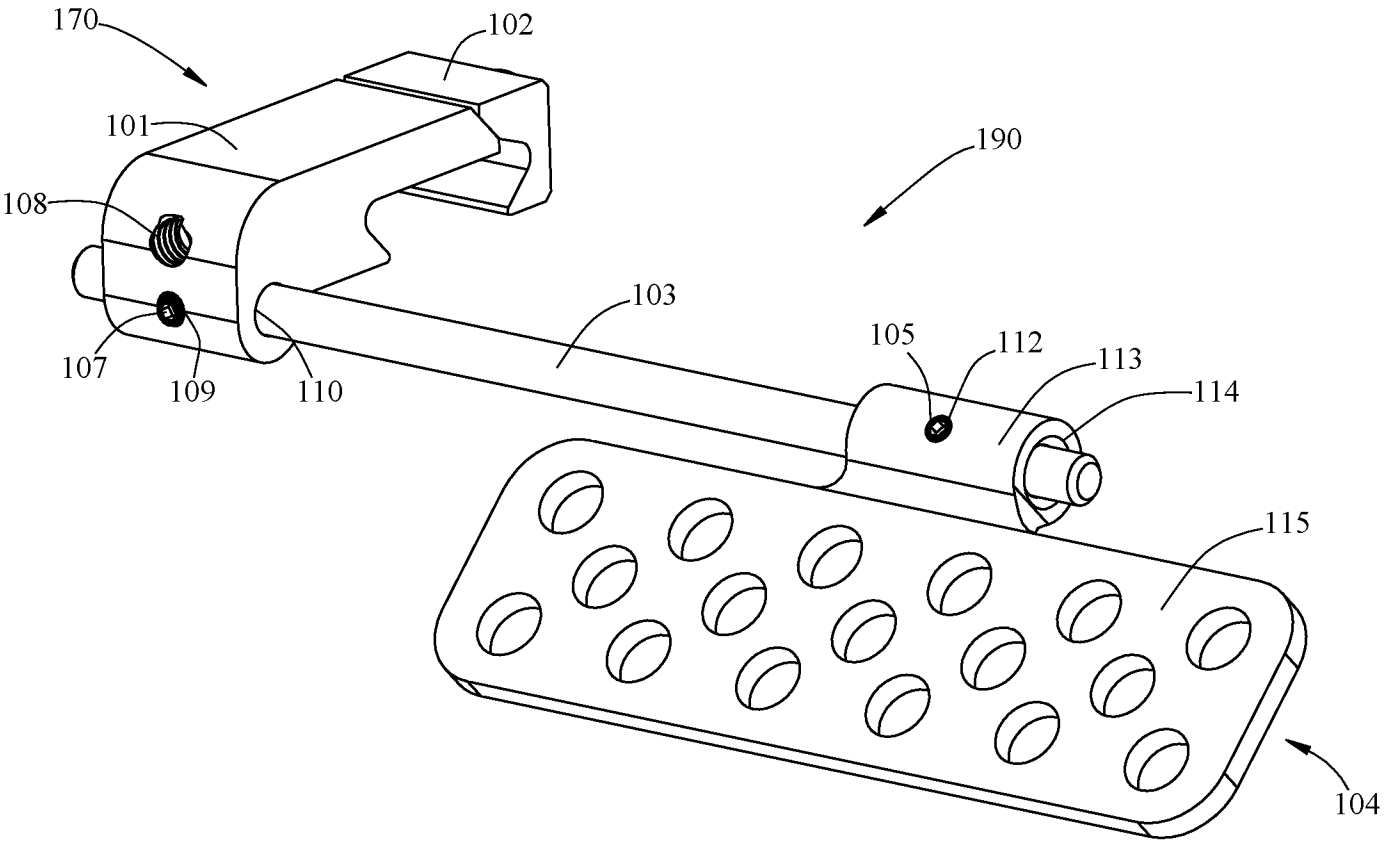
FIG. 20 is an assembly view of the third embodiment of the invention.
Figure 21:
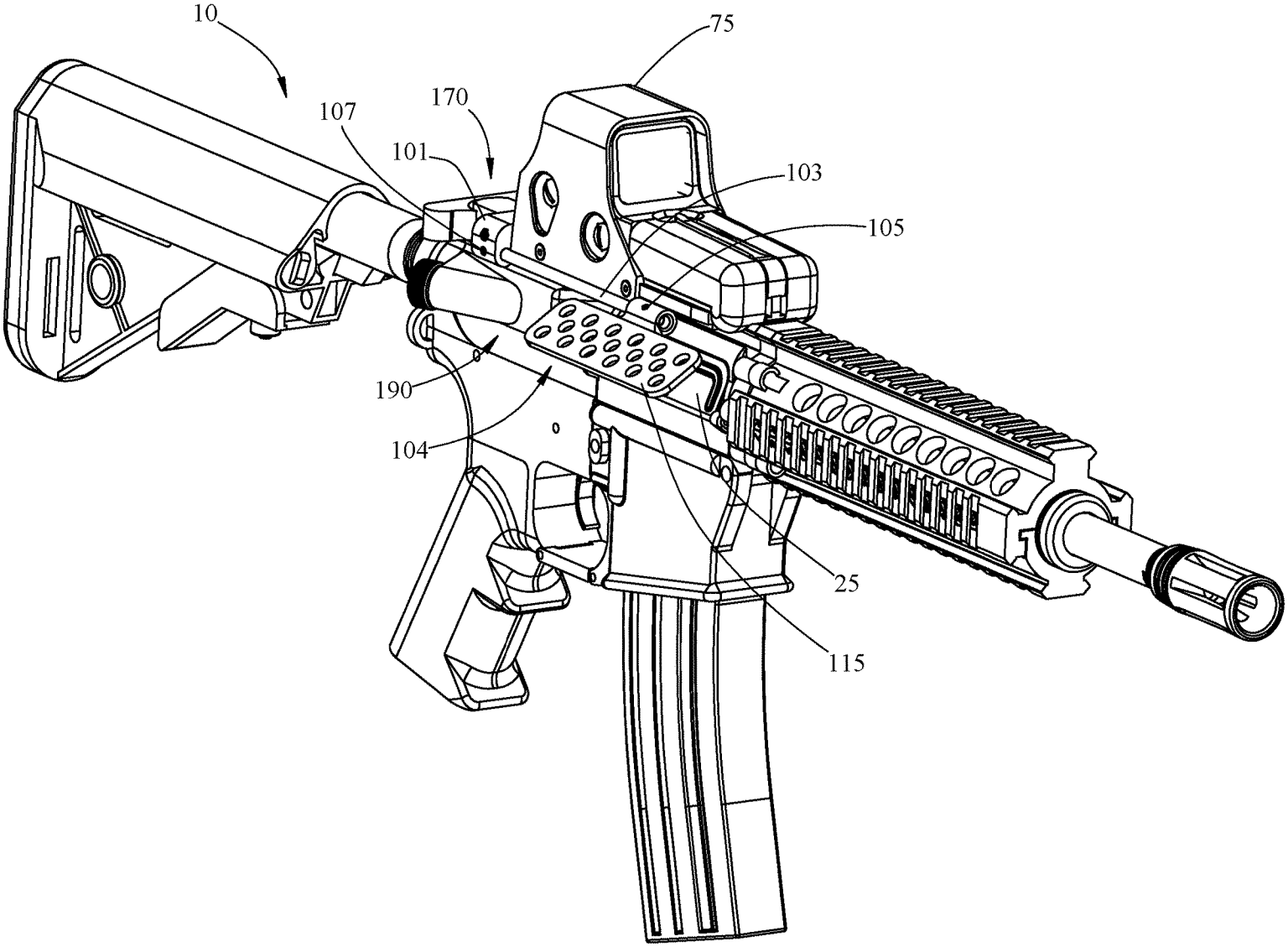
FIG. 21 is an elevated isometric view of the third embodiment mounted on a rifle.
Figure 22:
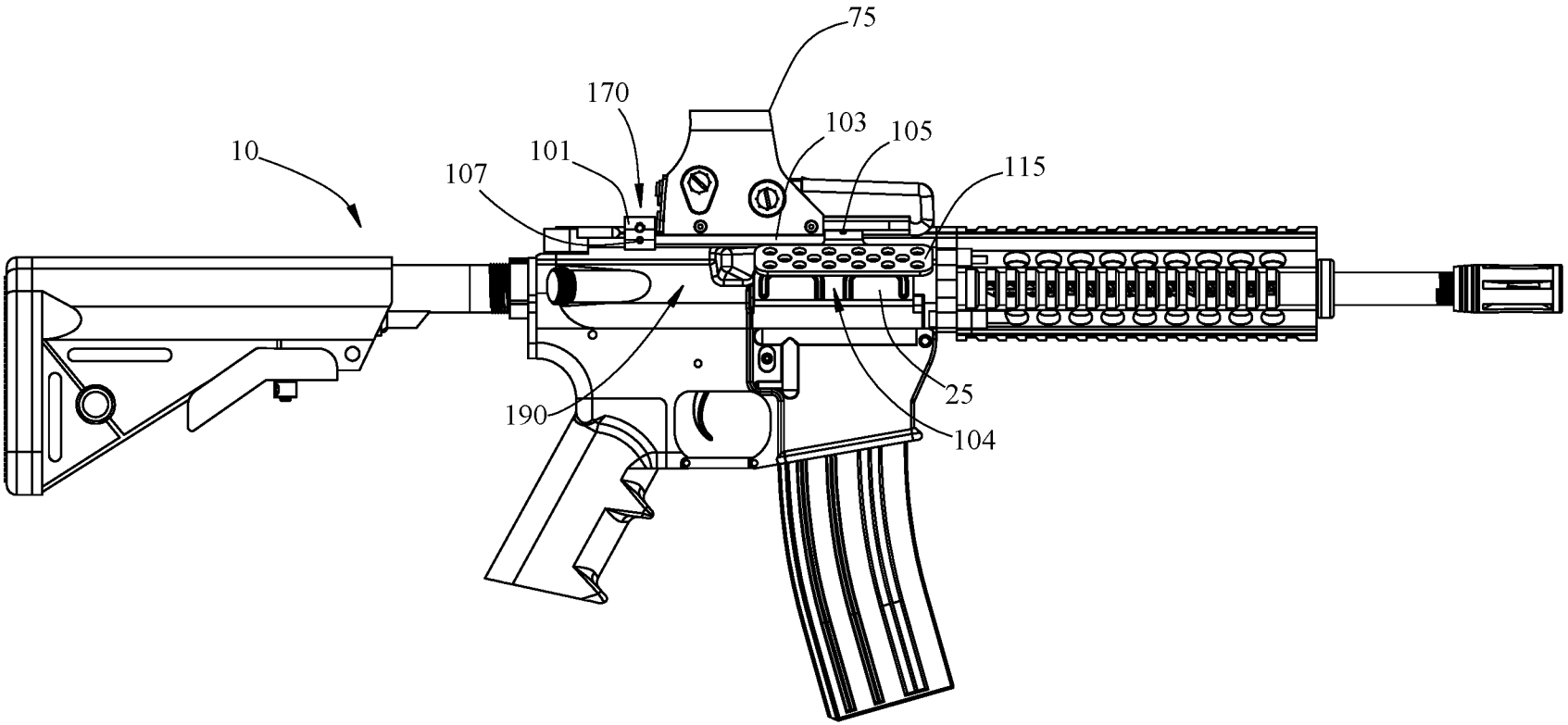
FIG. 22 is a side view of the third embodiment mounted on a rifle.
Figure 23:
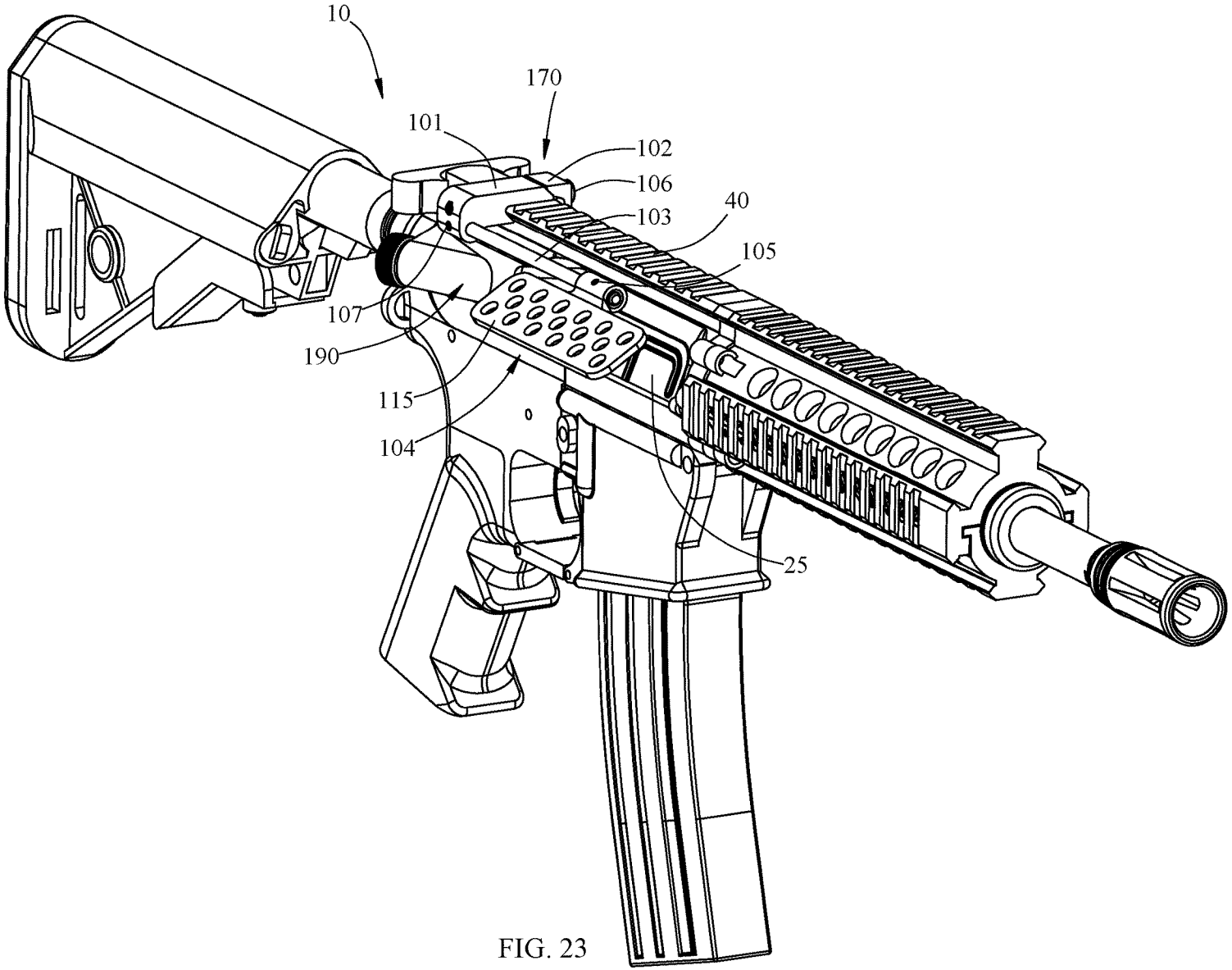
FIG. 23 is an elevated isometric view of the third embodiment mounted on a rifle with the site removed for clarity thereof.

In a third embodiment FIG. 20, rear mounted assembly 190, the universal, ambidextrous spent ammunition cartridge case deflector of the present invention can be adapted for use with a semiautomatic or automatic rifle 10, such as the AR-15 rifle depicted in FIGS. 1 and 2. Referring to FIG. 20 the mounting clamp assembly 170 is located at one end of the mounting rod 103 and the deflector 104 is positioned at the opposite end. The mounting clamp assembly 170 is positioned in the second embodiment with clamp body 101 facing the right hand side of the rifle 10 and the clamp lock 102 and clamp lock threaded fastener 106 positioned facing the left hand side. As shown in FIGS. 21 and 22, a red dot sighting device 75 has been mounted to the upper receiver rail 40. Referring to FIGS. 20,21 and 22, the clamp mounting assembly 170 is mounted rearward of the red dot sighting device 75 with the mounting rod 103 extending forward from the clamp mounting assembly 170. The deflector 104 is positioned with the deflector top 115 facing upwards directly above the ejection port 25. It is attached to the rifle 10 via the mounting rod 103 that is inserted into the deflector pivot means 113 in the deflector mounting rod aperture 114 and the clamp body 101 in the clamp body mounting rod aperture 110. The mounting rod 103 is retained in the clamp body mounting rod aperture 110 via a set screw 107 in the threaded bore 109. The mounting rod 103 is retained in the deflector mounting rod aperture 114 by the set screw 105 in threaded bore 112. This third embodiment 190 of the deflector, therefore, is intended for use with a rifle 10 in conjunction with a red dot scope 75 or other tactical sighting device or accessory attached to the upper receiver rail 40 that leaves space available on the upper receiver rail 40 rearward of the device and the ejection port to mount the mounting clamp assembly 170. FIG. 23 shows the third embodiment 190 mounting to the upper receiver rail 40 with the red dot scope 75 removed for additional clarity.

Figure 24:
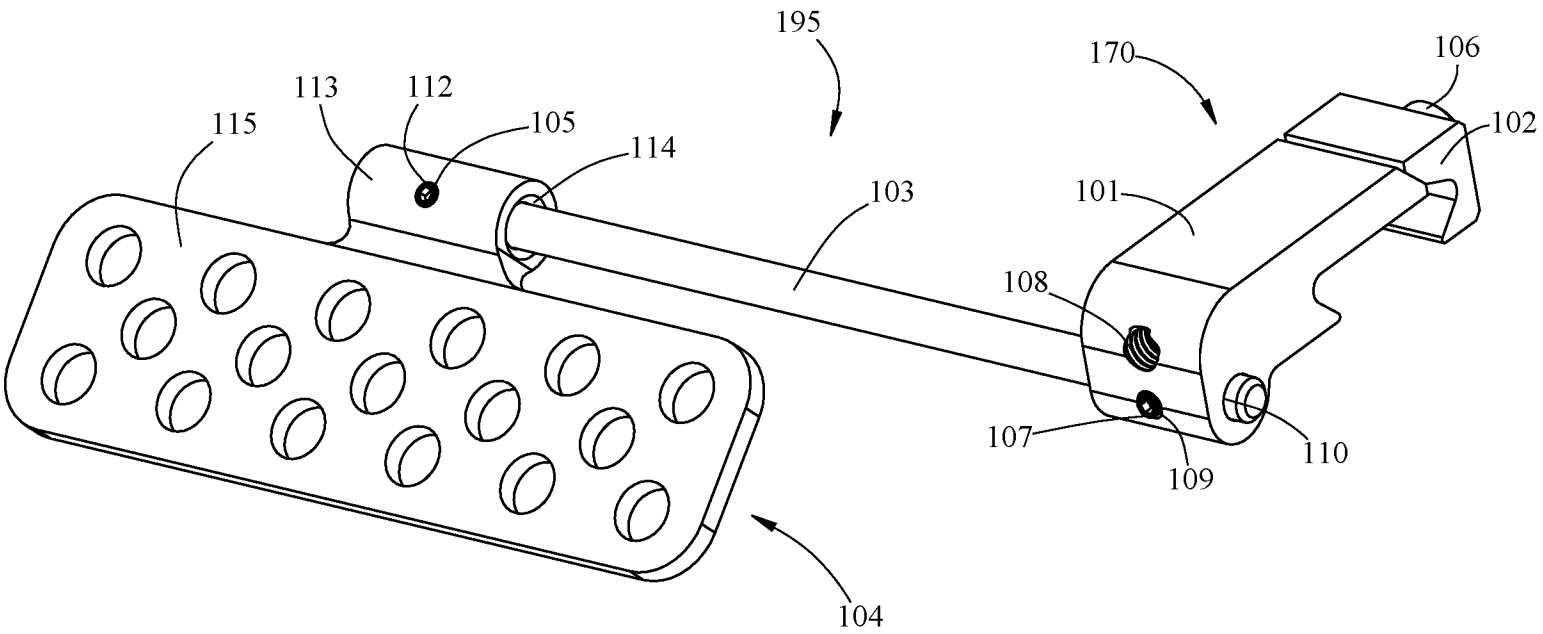
FIG. 24 an assembly view of the fourth embodiment of the invention.
Figure 25:
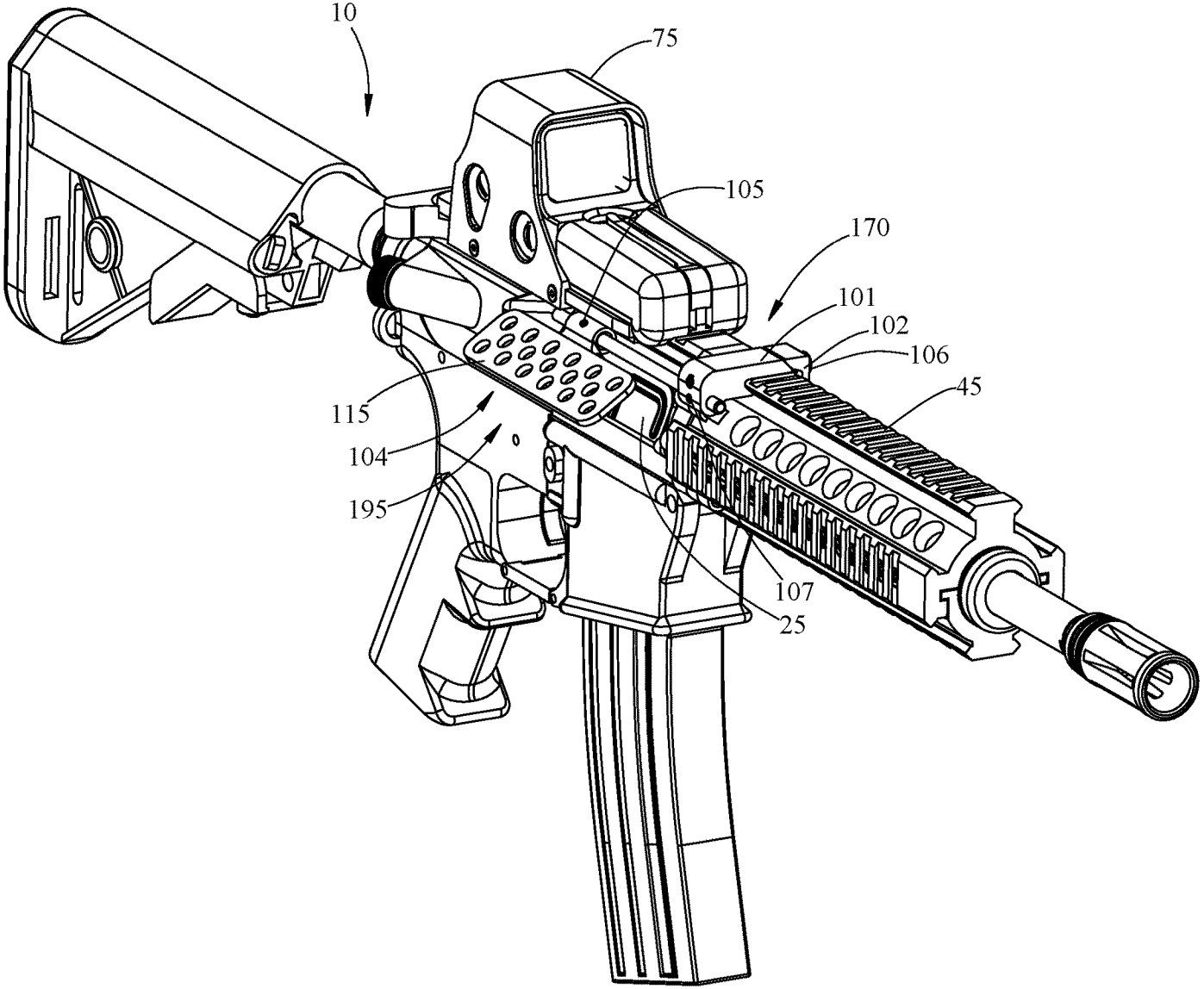
FIG. 25 is an elevated isometric view of the third embodiment mounted on a rifle.
Figure 26:
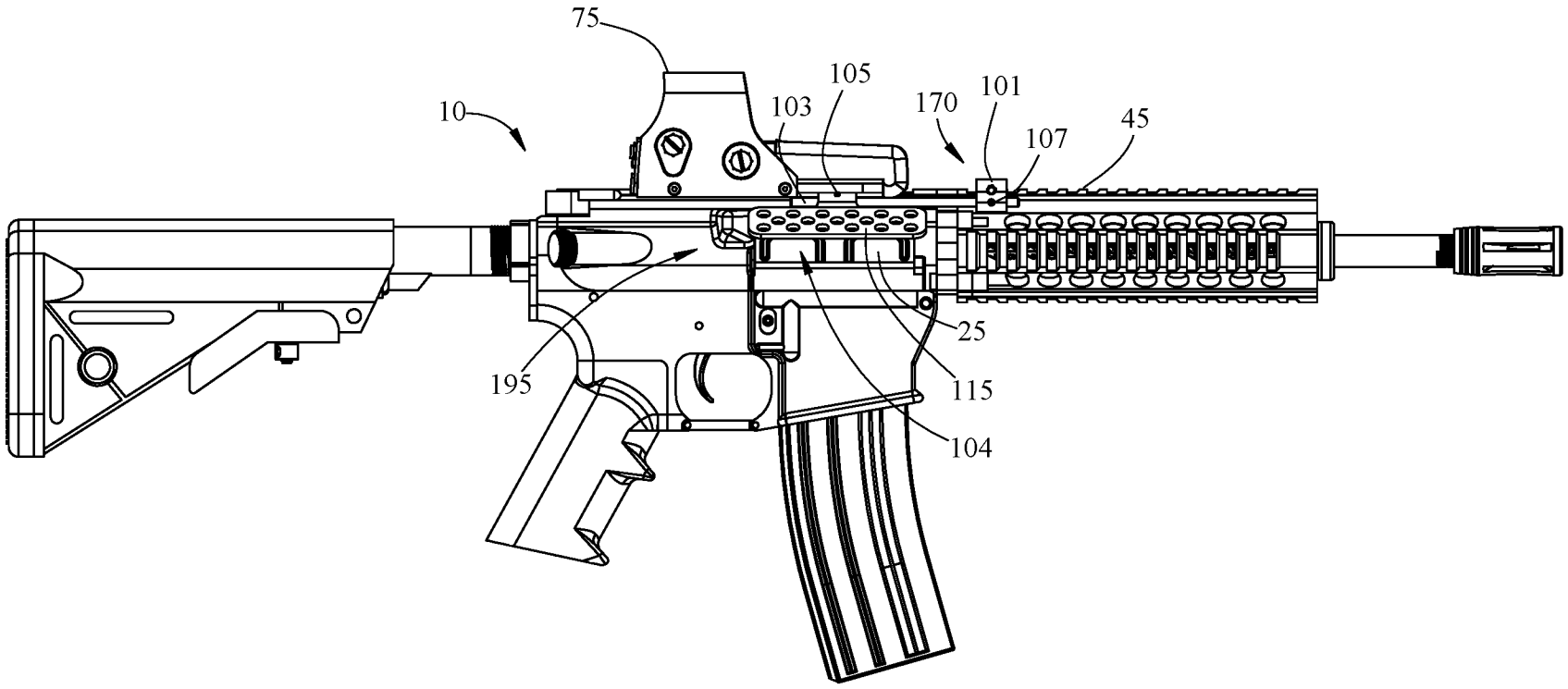
FIG. 26 is a side view of the third embodiment mounted on a rifle thereof.

In a fourth embodiment FIG. 24, forward mounted assembly 195, the universal, ambidextrous spent ammunition cartridge case deflector of the present invention can be adapted for use with a semiautomatic or automatic rifle 10, such as the AR-15 rifle depicted in FIGS. 1 and 2. As shown in FIGS. 25 and 26, a red dot scope 75 has been mounted to the upper receiver rail 40. Referring to FIGS. 24, 25 and 26, the clamp mounting assembly 170 is mounted forward of the red dot sighting device 75 with the mounting rod 103 extending rearward from the clamp mounting assembly 170. The clamp lock threaded fastener 106 and the clamp lock 102 are positioned facing the left side of the rifle 10 and the clamp body 101 is positioned on the right hand side of the rifle. The deflector 104 is positioned with the deflector top 115 facing upwards directly above the ejection port 25. It is attached to the rifle 10 via the mounting rod 103 that is inserted into the deflector pivot means 113 in the deflector mounting rod aperture 114 and the clamp body 101 in the clamp body mounting rod aperture 110. The mounting rod 103 is retained in the clamp body mounting rod aperture 110 via a set screw 107 in the threaded bore 109. The mounting rod 103 is retained in the deflector mounting rod aperture 114 by the set screw 105 in threaded bore 112. The fourth embodiment 195 of the deflector, therefore, is intended for use with a rifle 10 in conjunction with a red dot tactical sighting device 75, or other sighting device or accessory attached to the upper receiver rail 40 leaving no space available on the upper receiver rail 40 but with access to the forearm upper accessory rail 45 to mount the mounting clamp assembly 170.

Referring to FIGS. 1 and 2, there exists "left-handed" versions of the rifle 10. These rifles are identical to the rifle 10 except that they are a mirror image. The ejection port 25 and other components of the upper assembly 20 reversed from the right to the left side of the rifle. Referring to FIGS. 13, 17, 20 and 24, all embodiments of the present invention can be assembled in a similar "mirror image" such that all embodiments are functional on a left-handed version of the rifle 10 yielding a total of eight embodiments of the present invention.

From the foregoing description it will be clear that the present invention may be embodied in other specific forms without departing from the sprit or essential characteristics thereof. Thus, the presently disclosed embodiments are to be considered in all respects as illustrative and not restrictive, the scope of the invention being indicated by the appended claims, and not limited to the foregoing description. In particular, the invention is not restricted for use with an M4, AR-15 or AR-10 rifle, for it is within the ability of persons of ordinary skill in these arts to adapt the herein disclosed invention for use with a variety of types of semiautomatic and automatic rifles.

ABSTRACT OF THE DISCLOSURE

A safety device for redirecting spent ammunition cartridge cases away from a rifleman or bystander as they are ejected from the ejector port of a semiautomatic or automatic rifle. In a first embodiment, intended for use with a rifle which has space available on the upper receiver rail directly above or near the ejection port, the center mounted embodiment is preferred. The presented device includes a mounting clamp assembly, mounting rod and pivoting deflector. The deflector can be pivoted to permit the ejection pattern desired by the rifleman. In a second embodiment, the side mounted assembly, the mounting clamp assembly is attached to the right hand side rail of the forearm and barrel assembly when there is no available space on the upper receiver rail or forearm upper receiver rail. The mounting rod, extended rearward, and the deflector are maintained in their position above the ejection port. In the third embodiment, rear mounted assembly, the clamp mounting assembly is installed at the rear of the upper receiver rail when that space is available. The mounting rod, extended forward, and the deflector are maintained in their position above the ejection port. In a fourth embodiment, forward mounted assembly, the mounting clamp assembly is mounted on the forearm upper accessory mounting rail. The mounting rod, extended rearward, and the deflector are maintained in their position above the ejection port. All embodiments described herein apply to a left-handed version of the rifle.

I claim:

1. A universal ambidextrous spent ammunition cartridge case deflector that is attachable to a rifle, said rifle having an upper receiver rail, and a spent ammunition cartridge case ejector port disposed below said rail and on a right side or a left side of the rifle, comprising: a round mounting rod that extends longitudinally from a rear end to a front end; a mounting block means attached to the round mounting rod for mounting the deflector to said receiver rail; a deflector plate for downward deflection of spent ammunition cartridge cases as they are ejected out of the ejector port when the rifle is being fired; a pivot means attached to the mounting rod, whereby the deflector plate is adjustably attached to the mounting rod for movement;

wherein the mounting block means includes a clamp body having a transverse threaded bore, a clamp lock having a transverse bore, and a clamp bolt is inserted through the bore of the clamp lock, said bolt having mating threads for insertion and threaded engagement within the threaded bore of the clamp body;

wherein the clamp bolt is a cap head screw family;

wherein the mounting rod is inserted into the clamp body having a designated aperture disposed therein; and wherein the mounting rod is secured in the aperture by a set screw.

2. A spent ammunition cartridge case deflector that is attachable to a forearm attached side accessory rail of a rifle, said rail extending longitudinally from a rear end to a front end, said rifle having a spent ammunition cartridge case ejector port disposed behind said rail and on a right side or a left side of the rifle, comprising: a round mounting rod that extends longitudinally from a rear end to a front end; a mounting block means attached to the round mounting rod for mounting the deflector to said accessory rail; a deflector plate for downward deflection of spent ammunition cartridge cases as they are ejected out of the ejector port when the rifle is being fired; a pivot means attached to the mounting rod, whereby the deflector plate is pivotably attached to the mounting rod for movement;

wherein the mounting block means includes a clamp body having a transverse threaded bore, a clamp lock having a transverse bore, and a clamp bolt is inserted through the bore of the clamp lock, said bolt having mating threads for insertion and threaded engagement within the threaded bore of the clamp body;

wherein the clamp bolt is a cap head screw family;

wherein the mounting rod is inserted into the the clamp body having a designated aperture disposed therein; and wherein the mounting rod is secured in the aperture by a set screw.

3. The deflector of claim 1 or 2, wherein the pivot means has a tubular hinge portion that extends from an edge of the deflector plate generally centered in middle thereof, and a set screw for affixing the deflector to the mounting rod upon insertion of the mounting rod into the hinge portion.

4. The deflector of claim 3, wherein the deflector plate having at least one aperture for the escape of gases from said ejector port.

5. The deflector of claim 4, wherein the rifle is a member of the M4, AR-15, AR-10 or other modern sporting rifle design.

* * * * *